US008074378B2

(12) United States Patent
Wu

(10) Patent No.: US 8,074,378 B2
(45) Date of Patent: Dec. 13, 2011

(54) SHOCK ABSORBING DEVICE OF AN INSOLE OF A RESILIENT SHOE

(76) Inventor: Yun-Foo Wu, Hong Kong (CN)

( * ) Notice: Subject to any disclaimer, the term of this patent is extended or adjusted under 35 U.S.C. 154(b) by 825 days.

(21) Appl. No.: 11/597,195

(22) PCT Filed: Apr. 15, 2005

(86) PCT No.: PCT/CN2005/000505

§ 371 (c)(1),
(2), (4) Date: Feb. 15, 2008

(87) PCT Pub. No.: WO2005/115191

PCT Pub. Date: Dec. 8, 2005

(65) Prior Publication Data

US 2008/0216349 A1 Sep. 11, 2008

(30) Foreign Application Priority Data

May 24, 2004 (CN) ..... 2004 1 0027302

(51) Int. Cl.
*A43B 13/18* (2006.01)
*A43B 13/38* (2006.01)

(52) U.S. Cl. ..... 36/29; 36/44

(58) Field of Classification Search ..... 36/3 A, 36/3 R, 3 B, 29, 43, 44, 71, 147
See application file for complete search history.

(56) References Cited

U.S. PATENT DOCUMENTS

| | | | | | |
|---|---|---|---|---|---|
| 1,194,152 | A * | 8/1916 | Douglas | 36/28 |
| 2,010,151 | A * | 8/1935 | Helwig | 36/3 B |
| 3,765,422 | A * | 10/1973 | Smith | 36/153 |
| 4,219,945 | A * | 9/1980 | Rudy | 36/29 |
| 4,939,851 | A * | 7/1990 | Miller | 36/3 B |
| 4,991,317 | A * | 2/1991 | Lakic | 36/44 |
| 5,025,575 | A * | 6/1991 | Lakic | 36/44 |
| 6,138,382 | A * | 10/2000 | Schoesler | 36/43 |
| 2003/0121174 | A1 * | 7/2003 | Tsai et al. | 36/3 B |

* cited by examiner

*Primary Examiner* — Jila M Mohandesi
(74) *Attorney, Agent, or Firm* — Thomas R. Vigil

(57) ABSTRACT

A shock-absorbing method and device of an insole of a resilient shoe is provided. At least one transverse partition is set in a gas or liquid chamber of the insole. The gas or liquid chamber of the insole is partitioned into a fore cavity and a rear cavity by the partition. The fore cavity and the rear cavity are communicated reciprocally through the region external of the ends of the partition. Preferably, a fish-bone shaped partition is set longitudinally in the gas or liquid chamber. A column is set at the end of each of fish-bone branches of said fish-bone shaped partition and is positioned corresponding to a relevant acupoint of a human foot bottom. The gas or liquid chamber is filled with soft or resilient materials. The insole according to the invention could be shock absorbing and resilient.

8 Claims, 1 Drawing Sheet

SHOCK ABSORBING DEVICE OF AN INSOLE OF A RESILIENT SHOE

TECHNICAL FIELD

The present invention relates to parts and method for shoes, and more particularly, to shock-absorbing method and device of an insole of a resilient shoe.

BACKGROUND ART

In the prior art insole of a resilient shoe with gas or liquid chamber, gas or liquid is filled therein. But while walking, due to the too quick flow speed of the gas or liquid in the chamber, its buffering capability is not strong enough, which influences its effect of shocking-absorbing. Although its buffering capability could be improved by increasing the pressure of the gas or liquid in the chamber, the resilience of the insole of the resilient shoe will be reduced significantly, which can not satisfy the human requirements.

SUMMARY OF THE INVENTION

The present invention aims to provide a shock-absorbing method and device of an insole of a resilient shoe, so as to solve the problems in the prior art designs that the prior art device can not have good properties for both of the buffering capability and the resilience and therefore can not satisfy the human desires to the utmost.

The shock-absorbing method of an insole of a resilient shoe according to the present invention is as follows: in the gas or liquid chamber of the insole of the resilient shoe, at least one traverse partition is set, and said gas or liquid chamber is partitioned into a fore cavity and a rear cavity by said partition, and said fore cavity and rear cavity are communicated reciprocally through the region external of the ends of the partition.

Wherein in said gas or liquid chamber, a fish-bone shaped partition is set longitudinally, and a column is set at the end of each of fish-bone branches of said fish-bone shaped partition.

Wherein in said gas or liquid chamber, a side-partition is set inwards from the periphery of the insole of the resilient shoe, and a column is set at the end of said side-partition.

Wherein said partition, fish-bone shaped partition and side-partition directly connect with the bottom of the insole of the resilient shoe, which partition the gas or liquid chamber into cavities of corresponding shapes.

Wherein said partition is set at the interface between the fore sole and the rear ankle of a human foot bottom.

Wherein said column is positioned corresponding to a relevant acupoint of a human foot bottom.

A shock-absorbing device of an insole of a resilient shoe for realizing the above mentioned method, comprising a sole body, and said sole body has a gas or liquid chamber, wherein in said gas or liquid chamber, a traverse partition is set, and the gas or liquid chamber is partitioned into a fore cavity and a rear cavity by the partition, and said fore cavity and rear cavity are communicated reciprocally at the region external of the ends of the partition.

Wherein the width of the communication gap between the fore cavity and the rear cavity at the region external of the ends of the partition is ranged from 0.1 mm to 2 cm.

Wherein said gas or liquid chamber is filled with soft or resilient materials.

Wherein the thickness of said soft or resilient materials is ranged from 1 mm to 3 cm.

Wherein in said gas or liquid chamber, a fish-bone shaped partition is set longitudinally, and a column is set at the end of each of fish-bone branches of said fish-bone shaped partition; and a side-partition is set inwards from the periphery of the insole of the resilient shoe, and a column is set at the end of said side-partition.

The advantages of the present invention is that, according to the present invention, a partition is set in the gas or liquid chamber of the insole of the resilient shoe to partition the chamber into a fore cavity and a rear cavity, and the fore cavity and the rear cavity are communicated reciprocally through the region external of both ends of the partition, so that during walking, the heel touches the ground first, and pushes the rear cavity of the gas or liquid chamber; the gas or liquid in the rear cavity is squeezed into the fore cavity of the gas or liquid chamber. Due to the function of the partition, the passage, external of the ends of the partition, between the rear cavity and the fore cavity gets narrower, and the flow speed of squeezed gas or liquid is reduced, and the buffering capability is improved, wherein the improvement of buffering is realized without the need to increase the pressure of the gas or liquid in the gas or liquid chamber, thereby the comprehensive resilience of the present invention will not be reduced, and both of the buffering capability and resilience can be satisfactory. In addition, the present invention has simple structure and satisfies the human desires to the utmost. Particularly if the partition is set at the interface between the fore sole and the rear ankle of a human foot bottom, the present invention will be more conformed to the principles of body dynamics, so as to improve the applicability of the present invention. In the liquid or gas chamber, a fish-bone shaped partition is set longitudinally, and a column is set at the end of each of fish bone branches of the fish-bone shaped partition, and side-partitions are set inwards from the periphery of the insole of the resilient shoe, and a column is set at the end of each of side partitions, which help to improve the strength of the insole of the resilient shoe. And the column helps to reduce the focusing of the stress at the end of the fish-bone shaped partition or the side-partition, so as to prolong lifetime of the present invention. Since the resilience of the fish-bone shaped partition, side partition is not equal to that of the gas or liquid chamber, a massage effect to the foot bottom will be generated thereby. And if the column is positioned corresponding to a relevant acupoint of the human foot bottom, the massage effect will be better, and the applicability of the present invention will be improved. In summary, the present invention has good buffering capability and resilience capability, a simple structure and a widely applicability, and generates massage effect during use, so as to satisfy the human desires to the utmost.

DETAILED DESCRIPTION OF THE PREFERRED EMBODIMENTS

Figure 1:
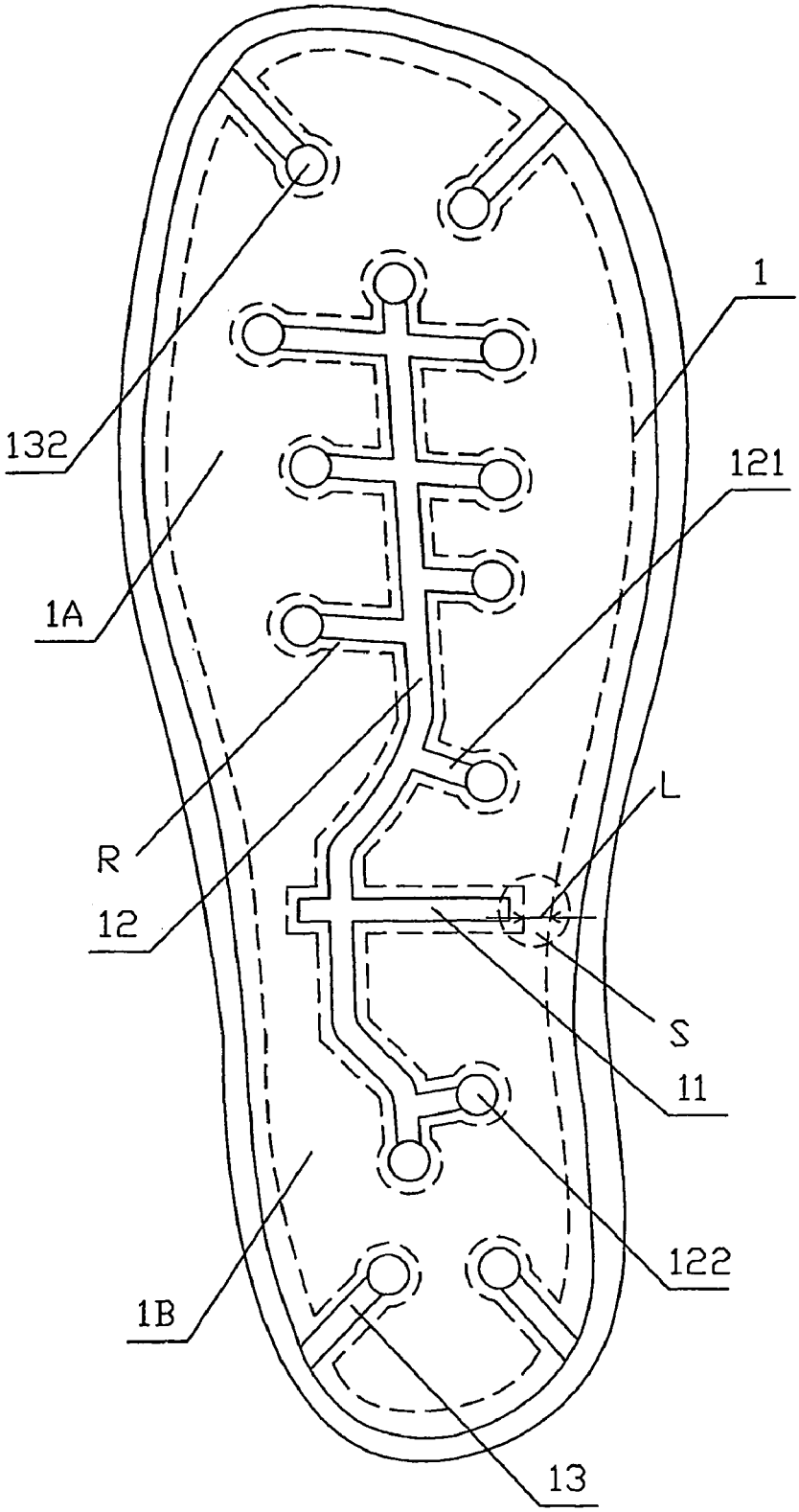
FIG. 1 is a top view showing the structure of the insole body of the present invention.

Hereinafter the present invention will be described in details with reference to the accompanying drawing and embodiments.

According to FIG. 1, the present invention includes an insole body. As shown in FIG. 1, said insole body has a gas or liquid chamber 1, and a transverse partition 11 is set inside the gas or liquid chamber 1. The gas or liquid chamber 1 is partitioned into a fore cavity 1A and a rear cavity 1B by the partition 11, and said fore cavity 1A and said rear cavity 1B are communicated reciprocally through the region external of the ends of the partition 11. As shown in FIG. 1, the fore cavity 1A and the rear cavity 1B are communicated reciprocally through the part S, wherein the width L of the communication gap between the fore chamber 1A and the rear chamber 1B is ranged from 0.1 mm to 2 cm. As shown in FIG. 1, the partition 11 is set at the interface between the fore sole and the rear ankle of a human foot bottom.

As shown in FIG. 1, in the gas or liquid chamber 1, a fish-one shaped partition 12 is set longitudinally, and a column 122 is set at the end of each of fish bone branches 121 of the fish-bone shaped partition 12. As shown in FIG. 1, the trunk of said fish-bone shaped partition 12 passes through the partition 11, with its fish bone branches 121 and corresponding columns 122 spreading all over in the fore cavity 1A and the rear cavity 1B. As shown in FIG. 1, side-partitions 13 are set inwards from the periphery of the insole body, with a column 132 set at the end of each of the side-partitions 13. As shown in FIG. 1, one side-partition 13 is set respectively at the left upper side and the right upper side of the fore cavity 1A, and at the left lower side and right lower side of the rear cavity 1B.

As shown in FIG. 1, the partition 11 and fish-bone shaped partition 12 and side-partitions 13 directly connect with the bottom of the insole body, which partition the gas or liquid chamber 1 into cavities of corresponding shapes. A side-slot R is formed between the partitions 11, 12, 13 and the gas or liquid chamber 1, and the partition 11, fish-bone shaped partition 12 and side-partitions 13 are of the same level as the upper end of the cavities of corresponding shapes. And each of the columns 122, 132 is positioned corresponding to a relevant acupoint of a human foot bottom.

While using the present invention, during walking, the heel touches the ground first, and pushes the rear cavity 1B of the gas or liquid chamber 1; the gas or liquid in the rear cavity 1B is squeezed through the part S external of the ends of the partition 11 into the fore cavity 1A of the gas or liquid chamber 1. Due to the function of the partition 11, the passage, external of the ends of the partition 11, between the rear cavity and the fore cavity gets narrower, and the flow speed of squeezed gas or liquid is reduced, and the buffering capability is improved, wherein the improvement of buffering is realized without the need to increase the pressure of the gas or liquid in the gas or liquid chamber 1, thereby the comprehensive resilience of the present invention will not be reduced. In the present invention, the gas or liquid chamber 1 could be filled with soft and resilient materials, and the thickness of the soft and resilient materials is ranged from 1 mm to 3 cm, so as to reinforce the comprehensive strength of the insole of a resilient shoe.

In this embodiment, only one traverse partition 11 is set in the gas or liquid chamber 1, however two or more than two partitions 11 could be set with a same or similar structure and working principle as mentioned above, therefore, it is not necessary to describe in details here.

The invention claimed is:

1. A shock-absorbing device of an insole of a resilient shoe, comprising a sole body, wherein said sole body has a gas or liquid chamber, in said gas or liquid chamber, a fish-bone shaped partition with a plurality of fish-bone branches is set longitudinally, and a column is set at the end of each fish-bone branch, and in said gas or liquid chamber, a traverse partition is set, and the gas or liquid chamber is partitioned into a fore cavity and a rear cavity by the traverse partition, and said fore cavity and rear cavity are communicated reciprocally through two communication gaps between the fore cavity and the rear cavity, each of the two communication gaps is located at the region external of one of the two ends of the traverse partition;

and in said gas or liquid chamber, at least one side-partition is set inwards from the periphery of the insole of the resilient shoe, and a column is set at the end of said side-partition, each of the columns is positioned corresponding to a relevant acupoint of a human foot bottom.

2. A shock-absorbing device of an insole of a resilient shoe as claimed in claim 1, wherein width of the communication gap is ranged from 0.1 mm to 2 cm.

3. A shock-absorbing device of an insole of a resilient shoe as claimed in claim 1, wherein said gas or liquid chamber is filled with soft or resilient materials.

4. A shock-absorbing device of an insole of a resilient shoe as claimed in claim 3, wherein thickness of said soft or resilient materials is ranged from 1 mm to 3 cm.

5. A shock-absorbing device of an insole of a resilient shoe as claimed in claim 1, wherein in said gas or liquid chamber, a fish-bone shaped partition having plurality of fish-bone branches is set longitudinally, and a column is set at the end of each fish-bone branches.

6. A shock-absorbing device of an insole of a resilient shoe as claimed in claim 1, wherein said traverse partition, fish-bone shaped partition and side-partition directly connect with the bottom of the insole of the resilient shoe, which partition the gas or liquid chamber forms into cavities of corresponding shapes.

7. A method for forming a shock-absorbing device of an insole of a resilient shoe as claimed in claim 1, comprising following steps:

providing a sole body with a gas or liquid chamber, setting at least one traverse partition in the gas or liquid chamber, so that said gas or liquid chamber is partitioned into a fore cavity and a rear cavity by said traverse partition, and said fore cavity and rear cavity are communicated reciprocally through two communication gaps between the fore cavity and the rear cavity, each of the two communication gaps is located at the region external of one of the two ends of the traverse partition;

setting longitudinally one fish-bone shaped partition with a plurality of fish-bone branches in said gas or liquid chamber, and setting a column at the end of each fish-bone branch; and setting at least one side-partition inwards from the periphery of the insole of the resilient shoe in said gas or liquid chamber, and setting a column at the end of said side-partition, each of the columns is positioned corresponding to a relevant acupoint of a human foot bottom.

8. A method for forming a shock-absorbing device of an insole of a resilient shoe as claimed in claim 7, wherein width of the communication gap is ranged from 0.1 mm to 2 cm.

* * * * *

UNITED STATES PATENT AND TRADEMARK OFFICE

CERTIFICATE OF CORRECTION

PATENT NO. : 8,074,378 B2
APPLICATION NO. : 11/597195
DATED : December 13, 2011
INVENTOR(S) : Yun-Foo Wu It is certified that error appears in the above-identified patent and that said Letters Patent is hereby corrected as shown below:

Title Page: Change:

"(54) SHOCK ABSORBING DEVICE OF AN INSOLE OF A RESILIENT SHOE"

to:
--(54) SHOCK ABSORBING METHOD AND DEVICE OF AN INSOLE OF A RESILIENT SHOE--

Signed and Sealed this
Tenth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,074,378 B2
APPLICATION NO. : 11/597195
DATED : December 13, 2011
INVENTOR(S) : Yun-Foo Wu It is certified that error appears in the above-identified patent and that said Letters Patent is hereby corrected as shown below:

Title Page, Item (54) and at Column 1, lines 1 and 2, Title Change:

"SHOCK ABSORBING DEVICE OF AN INSOLE OF A RESILIENT SHOE"

to:
--SHOCK ABSORBING METHOD AND DEVICE OF AN INSOLE OF A RESILIENT SHOE--

This certificate supersedes the Certificate of Correction issued July 10, 2012.

Signed and Sealed this
Fourteenth Day of August, 2012

David J. Kappos

David J. Kappos
*Director of the United States Patent and Trademark Office*